US011547258B2

(12) United States Patent
Conrad

(10) Patent No.: US 11,547,258 B2
(45) Date of Patent: Jan. 10, 2023

(54) SURFACE CLEANING APPARATUS

(71) Applicant: Omachron Intellectual Property Inc., Hampton (CA)

(72) Inventor: Wayne Ernest Conrad, Hampton (CA)

(73) Assignee: Omachron Intellectual Property Inc., Hampton (CA)

( * ) Notice: Subject to any disclaimer, the term of this patent is extended or adjusted under 35 U.S.C. 154(b) by 155 days.

(21) Appl. No.: 17/100,513

(22) Filed: Nov. 20, 2020

(65) Prior Publication Data

US 2022/0160197 A1 May 26, 2022

(51) Int. Cl.

| | |
|---|---|
| ***A47L 5/24*** | (2006.01) |
| ***A47L 9/16*** | (2006.01) |
| ***A47L 9/14*** | (2006.01) |
| ***A47L 9/20*** | (2006.01) |

(52) U.S. Cl.

CPC ..... *A47L 9/149* (2013.01); *A47L 5/24* (2013.01); *A47L 9/165* (2013.01); *A47L 9/1666* (2013.01); *A47L 9/1683* (2013.01); *A47L 9/20* (2013.01)

(58) Field of Classification Search

CPC ..... A47L 9/149; A47L 9/165; A47L 9/1666; A47L 9/1683; A47L 9/20; A47L 5/24; A47L 9/1658; A47L 9/102; A47L 9/1608

USPC ..... 15/344, 347, 353

See application file for complete search history.

(56) References Cited

U.S. PATENT DOCUMENTS

| | | | | |
|---|---|---|---|---|
| RE42,873 | E | 11/2011 | Walker et al. | |
| 2014/0237757 | A1* | 8/2014 | Conrad | A47L 9/1608 15/353 |
| 2020/0237171 | A1* | 7/2020 | Xu | A47L 9/1641 |

* cited by examiner

*Primary Examiner* — Joseph J Hail
*Assistant Examiner* — Caleb Andrew Holizna
(74) *Attorney, Agent, or Firm* — Philip C. Mendes da Costa; Bereskin & Parr LLP/S.E.N.C.R, L., s.r.l.

(57) ABSTRACT

A hand held surface cleaning apparatus comprises a generally spherical cyclone chamber having dual cyclone air outlets and dual dirt outlets.

20 Claims, 13 Drawing Sheets

SURFACE CLEANING APPARATUS

FIELD

This application relates to the field of cyclonic air treatment members and surface cleaning apparatus including the same.

INTRODUCTION

The following is not an admission that anything discussed below is part of the prior art or part of the common general knowledge of a person skilled in the art.

Various types of surface cleaning apparatus are known, including upright surface cleaning apparatus, canister surface cleaning apparatus, stick surface cleaning apparatus, central vacuum systems, and hand carriable surface cleaning apparatus such as hand vacuums. Further, various designs for cyclonic hand vacuum cleaners, including battery operated cyclonic hand vacuum cleaners, are known in the art.

Surface cleaning apparatus are known which utilize one or more cyclones. A cyclone has a dirt collection region. The dirt collection region may be internal of the cyclone chamber (e.g., the dirt collection region may be a lower end of the cyclone chamber). Alternately, the dirt collection region may be a separate dirt collection chamber that is external to the cyclone chamber and in communication with the cyclone chamber via a dirt outlet. The dirt outlet may be a slot formed in the sidewall of a cyclone chamber or a gap provided between the end of the cyclone wall and an end of the cyclone chamber.

SUMMARY

In accordance with one aspect of this disclosure, there is provided a hand held surface cleaning apparatus having a cyclone chamber, which may be a generally spherical cyclone chamber, and a dirt collection chamber external to the cyclone chamber. The cyclone has opposed lateral sides and a central portion provided between the opposed sides. The central portion has a cyclone air inlet. The surface cleaning apparatus has a first dirt outlet provided on one lateral side of the air inlet and a second dirt outlet provided on the other lateral side of the air inlet. An advantage of this design is that dirt, which is disentrained by the cyclone chamber, may transit to the dirt collection chamber through two dirt outlets. Accordingly, the separation efficiency of a generally spherical cyclone may be increased. A further advantage is that the tendency of dirt to be re-entrained in the air rotating in the cyclone chamber may be reduced.

In accordance with this aspect, there is provided a hand held surface cleaning apparatus comprising:

a) a body having a front end, a rear end, a body axis extending between the front and rear ends and first and second laterally opposed sides positioned on opposed sides of the body axis;

b) an air flow path extending from a dirty air inlet to a clean air outlet, the dirty air inlet is located at the front end;

c) an air treatment member provided in the air flow path, the air treatment member having a front end, a rear end, first and second laterally opposed sides, an air treatment member air inlet centrally positioned between the first and second laterally opposed sides of the air treatment member, a first air outlet provided in the first laterally opposed side of the air treatment member, a second air outlet provided in the second laterally opposed side of the air treatment member, a first dirt outlet provided between the body axis and the first laterally opposed side of the air treatment member and a second dirt outlet provided between the body axis and the second laterally opposed side of the air treatment member;

d) at least one dirt collection chamber in communication with the dirt outlets; and, e) a suction motor provided in the air flow path.

In any embodiment, the at least one dirt collection chamber may comprise a dirt collection chamber wherein at least a portion of the dirt collection chamber may be positioned forward of the air treatment member.

In any embodiment, a forward side of the air treatment member may have a wall portion that may extend laterally between the first and second dirt outlets.

In any embodiment, an inlet passage may extend from the dirty air inlet to the air treatment member and, when the inlet passage is oriented generally horizontally and the dirty air inlet is located at an upper end of the hand held surface cleaning apparatus, the air treatment member air inlet may be located in an upper end of the air treatment member and the wall portion may extend downwardly from the air treatment member air inlet.

In any embodiment, the wall portion may be moveably mounted between a closed position and an open position in which the air treatment member is opened whereby the air treatment member may be emptyable.

In any embodiment, the at least one dirt collection chamber may be a single dirt collection chamber.

In any embodiment, the air treatment member may comprise a cyclone.

In any embodiment, the air treatment member may be generally spherical.

In any embodiment, the first dirt outlet may have a width in a plane transverse to the body axis and at least 50% of the width may be positioned between the air inlet and the first lateral side.

In any embodiment, the first dirt outlet may have a width in a plane transverse to the body axis and at least 75% of the width may be positioned between the air inlet and the first lateral side.

In any embodiment, in use, the dirty air inlet may be located at an upper end of the hand held surface cleaning apparatus and the air treatment member air inlet may be located in an upper end of the air treatment member and the first and second dirt outlets may be located below the air treatment member air inlet.

In accordance with this aspect, there is also provided a surface cleaning apparatus comprising:

a) an air flow path extending from a dirty air inlet to a clean air outlet;

b) a generally spherical air treatment member provided in the air flow path, the air treatment member having a volume defined by first and second opposed portions and third and fourth opposed portions, the first portion extends between one side of the third and fourth portions and the opposed second portion extends between another side of the third and fourth opposed portions, the air treatment member has an air treatment member air inlet positioned in the first portion, a first air outlet provided in the third portion, a second air outlet provided in the fourth portion, a first dirt outlet provided in the first portion wherein at least a portion of the first dirt outlet is positioned between the air treatment member air inlet and the third portion and a second dirt outlet wherein at least a portion of the second dirt outlet is positioned between the air treatment member air inlet and the fourth portion;

c) at least one dirt collection chamber in communication with the dirt outlets; and, d) a suction motor provided in the air flow path.

In any embodiment, the at least one dirt collection chamber may be a single dirt collection chamber.

In any embodiment, the air treatment member may comprise a cyclone.

In any embodiment, at least 50% of the first dirt outlet may be positioned between the air treatment member air inlet and the third portion.

In any embodiment, at least 75% of the first dirt outlet may be positioned between the air treatment member air inlet and the third portion.

In any embodiment, the first portion may be moveably mounted between a closed position and an open position in which the air treatment member is opened whereby the air treatment member may be emptyable.

In accordance with this aspect, there is also provided a surface cleaning apparatus comprising:

a) an air flow path extending from a dirty air inlet to a clean air outlet;

b) an air treatment member provided in the air flow path, the air treatment member comprising an air treatment member air inlet, a first air outlet, a second opposed air outlet, a first dirt outlet and a second dirt outlet wherein the first and second dirt outlets are provided in a wall portion and the wall portion is moveably mounted between a closed position and an open position in which the air treatment member is opened whereby the air treatment member is emptyable;

c) at least one dirt collection chamber in communication with the dirt outlets; and, d) a suction motor provided in the air flow path.

In any embodiment, the at least one dirt collection chamber may be a single dirt collection chamber.

In any embodiment, the surface cleaning apparatus may further comprise a front end, a rear end, an axis extending between the front and rear ends and first and second laterally opposed sides positioned on opposed sides of the axis, wherein the first dirt outlet may have an outer side positioned adjacent the first lateral side and an opposed inner side, the second dirt outlet may have an outer side positioned adjacent the second lateral side and an opposed inner side and the air treatment member may have a wall portion positioned between the inner side of the first dirt outlet and the inner side of the second dirt outlet.

These and other aspects and features of various embodiments will be described in greater detail below.

BRIEF DESCRIPTION OF THE DRAWINGS

For a better understanding of the described embodiments and to show more clearly how they may be carried into effect, reference will now be made, by way of example, to the accompanying drawings in which.

Figure 1:
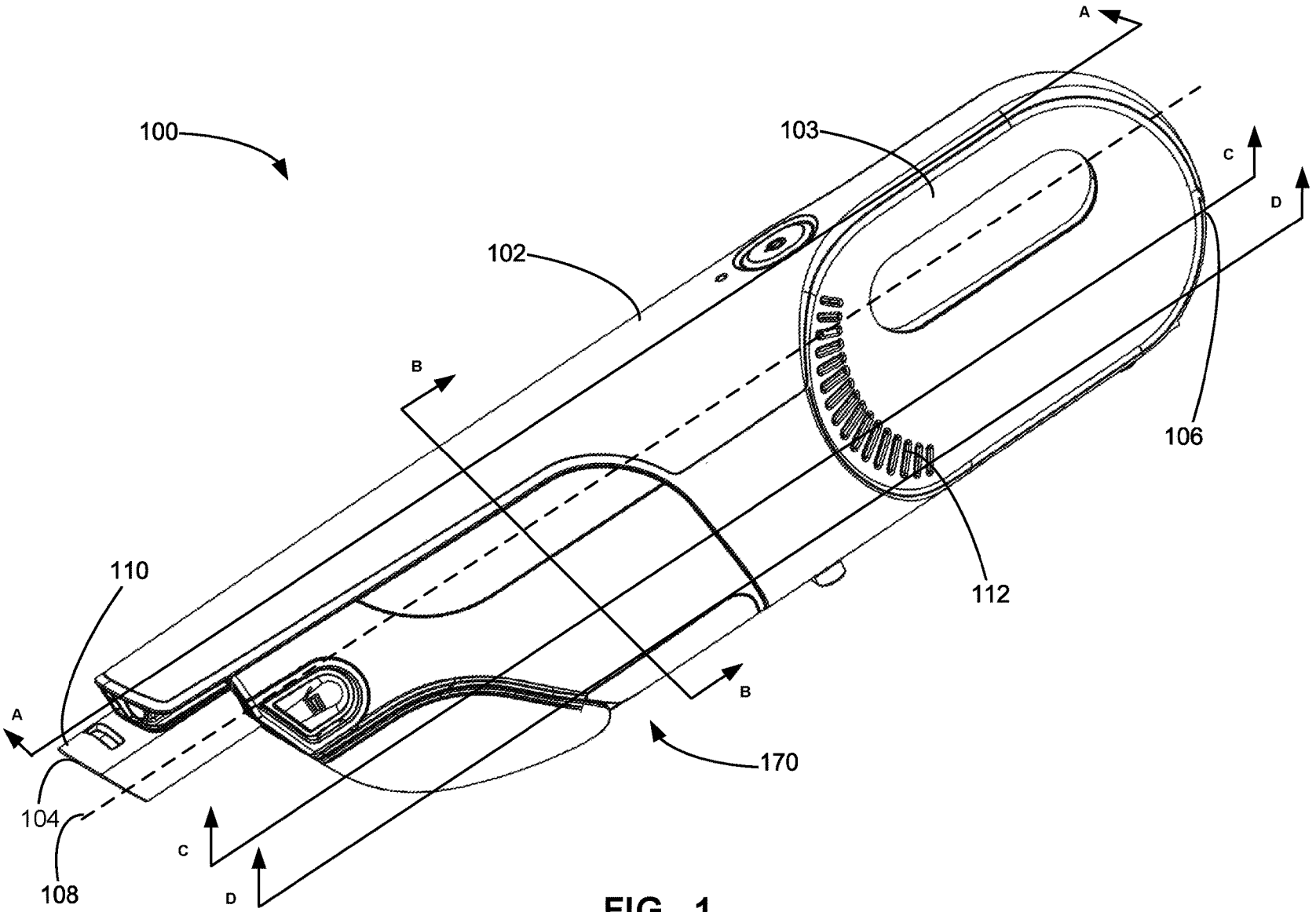
FIG. 1 is a perspective view of a surface cleaning apparatus in accordance with an embodiment.

The drawings included herewith are for illustrating various examples of articles, methods, and apparatuses of the teaching of the present specification and are not intended to limit the scope of what is taught in any way.

DESCRIPTION OF EXAMPLE EMBODIMENTS

Various apparatuses, methods and compositions are described below to provide an example of an embodiment of each claimed invention. No embodiment described below limits any claimed invention and any claimed invention may cover apparatuses and methods that differ from those described below. The claimed inventions are not limited to apparatuses, methods and compositions having all of the features of any one apparatus, method or composition described below or to features common to multiple or all of the apparatuses, methods or compositions described below. It is possible that an apparatus, method or composition described below is not an embodiment of any claimed invention. Any invention disclosed in an apparatus, method or composition described below that is not claimed in this document may be the subject matter of another protective instrument, for example, a continuing patent application, and the applicant(s), inventor(s) and/or owner(s) do not intend to abandon, disclaim, or dedicate to the public any such invention by its disclosure in this document.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more parts are said to be "coupled", "connected", "attached", or "fastened" where the parts are joined or operate together either directly or indirectly (i.e., through one or more intermediate parts), so long as a link occurs. As used herein and in the claims, two or more parts are said to be "directly coupled", "directly connected", "directly attached", or "directly fastened" where the parts are connected in physical contact with each other. None of the terms "coupled", "connected", "attached", and "fastened" distinguish the manner in which two or more parts are joined together.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures, and components have not been described in detail so as not to obscure the example embodiments described herein. Also, the description is not to be considered as limiting the scope of the example embodiments described herein.

As used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

As used herein and in the claims, two elements are said to be "parallel" where those elements are parallel and spaced apart, or where those elements are collinear.

General Description of a Hand Vacuum Cleaner

Referring to FIGS. 1-13, an exemplary embodiment of a surface cleaning apparatus is shown generally as 100. The following is a general discussion of apparatus 100, which provides a basis for understanding several of the features that are discussed herein. As discussed subsequently, each of the features may be used individually or in any particular combination or sub-combination in this or in other embodiments disclosed herein.

Surface cleaning apparatus 100 may be any type of surface cleaning apparatus, including for example a hand vacuum cleaner as shown (see FIGS. 1-13), a stick vacuum cleaner, an upright vacuum cleaner, a canister vacuum cleaner, an extractor, or a wet/dry type vacuum cleaner.

In FIGS. 1-13, the surface cleaning apparatus 100 is illustrated as a hand vacuum cleaner, which may also be referred to also as a "handvac" or "hand-held vacuum cleaner". As used herein, a hand vacuum cleaner is a vacuum cleaner that can be operated to clean a surface generally one-handedly. That is, the entire weight of the vacuum may be held by the same one hand used to direct a dirty air inlet of the vacuum cleaner with respect to a surface to be cleaned. For example, handle 103 and dirty air inlet 110 may be rigidly coupled to each other (directly or indirectly), such as being integrally formed or separately molded and then non-removably secured together (e.g. adhesive or welding), so as to move as one while maintaining a constant orientation relative to each other. This is to be contrasted with canister and upright vacuum cleaners, whose weight is typically supported by a surface (e.g. a floor) during use. When a canister vacuum cleaner is operated, or when an upright vacuum cleaner is operated in a 'lift-away' configuration, a second hand is typically required to direct the dirty air inlet at the end of a flexible hose.

Still referring to FIGS. 1-13, surface cleaning apparatus 100 includes a main body or a handvac body 102 having an air treatment member 120 (which may be permanently affixed to the main body or may be removable in part or in whole therefrom for emptying), a dirty air inlet 110, clean air outlets 112, and an air flow path 114 extending between the dirty air inlet 110 and the clean air outlets 112.

Figure 7:
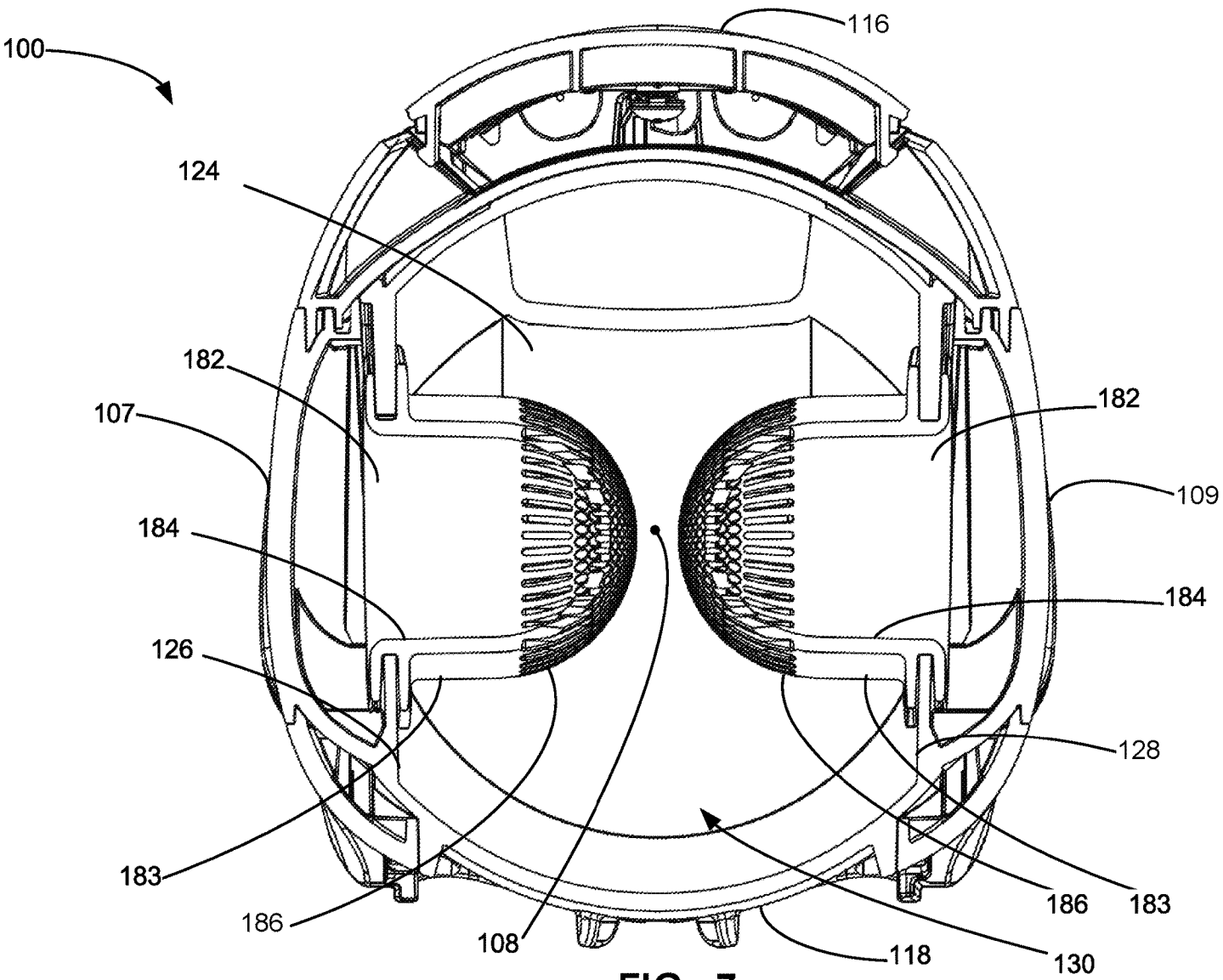
FIG. 7 is a cross-sectional front view of the surface cleaning apparatus of FIG. 1, along the line B-B in FIG. 1.

Surface cleaning apparatus 100 has a front end 104, a rear end 106, a body axis 108 extending between the front and rear ends 104, 106 (see FIG. 1), and first and second laterally opposed sides 107, 109 (see FIG. 7). The first and second laterally opposed sides 107, 109 are positioned on opposed sides of the body axis 108. The surface cleaning apparatus 100 has an upper end (also referred to as the top) 116, and a lower end (also referred to as the bottom) 118 (see FIG. 7). In the embodiment shown, dirty air inlet 110 is at an upper portion of apparatus front end 104 and two clean air outlets 112 are located on opposed lateral sides at a rearward portion of apparatus 100 at apparatus rear end 106 (see FIG. 9). It will be appreciated that dirty air inlet 110 and clean air outlets 112 may be positioned in different locations of apparatus 100. It will be appreciated that a single clean air outlet 112 may be provided.

Figure 2:
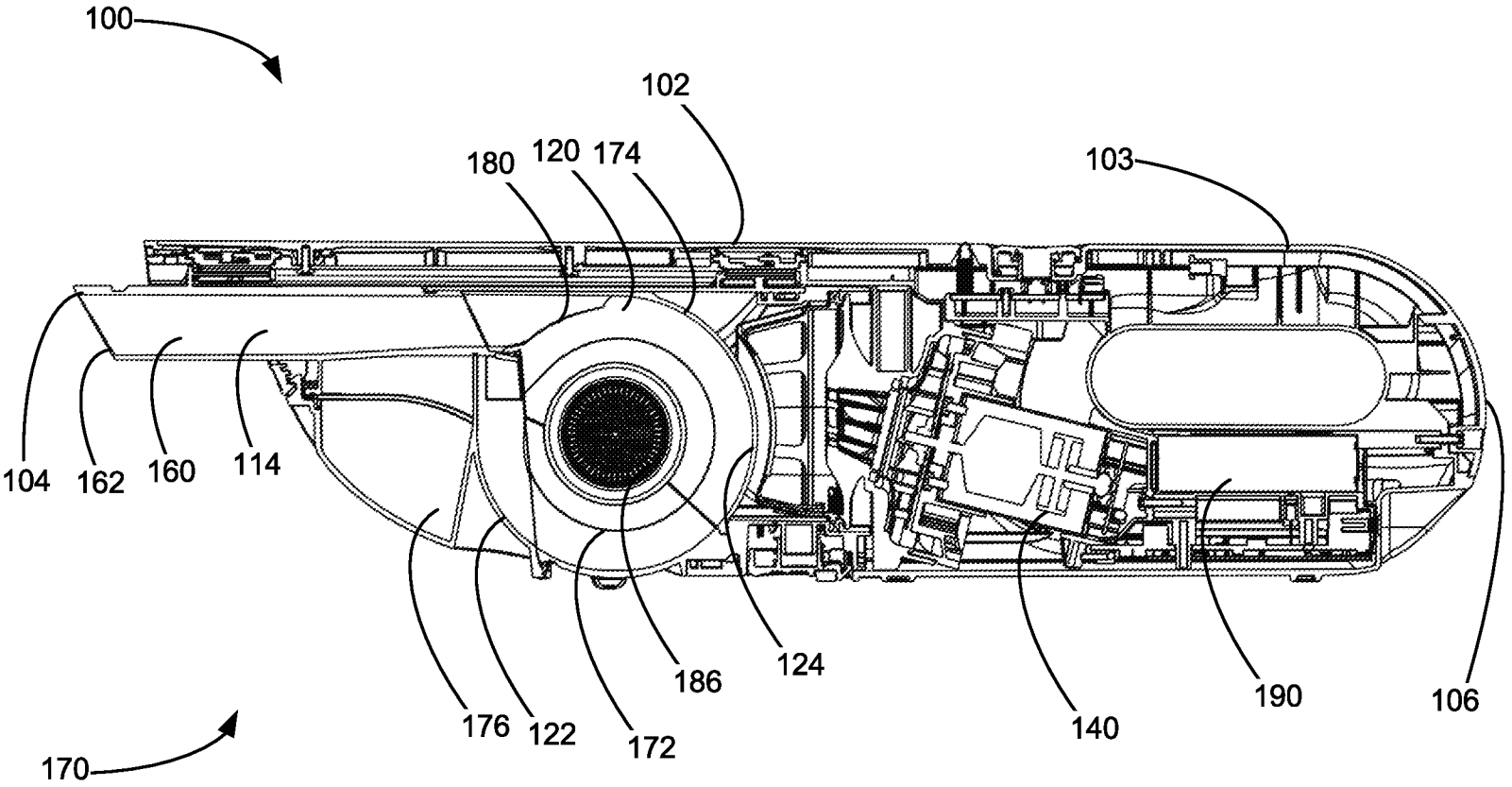
FIG. 2 is a cross-sectional side view of the surface cleaning apparatus of FIG. 1, along the line A-A in FIG. 1.
Figure 3:
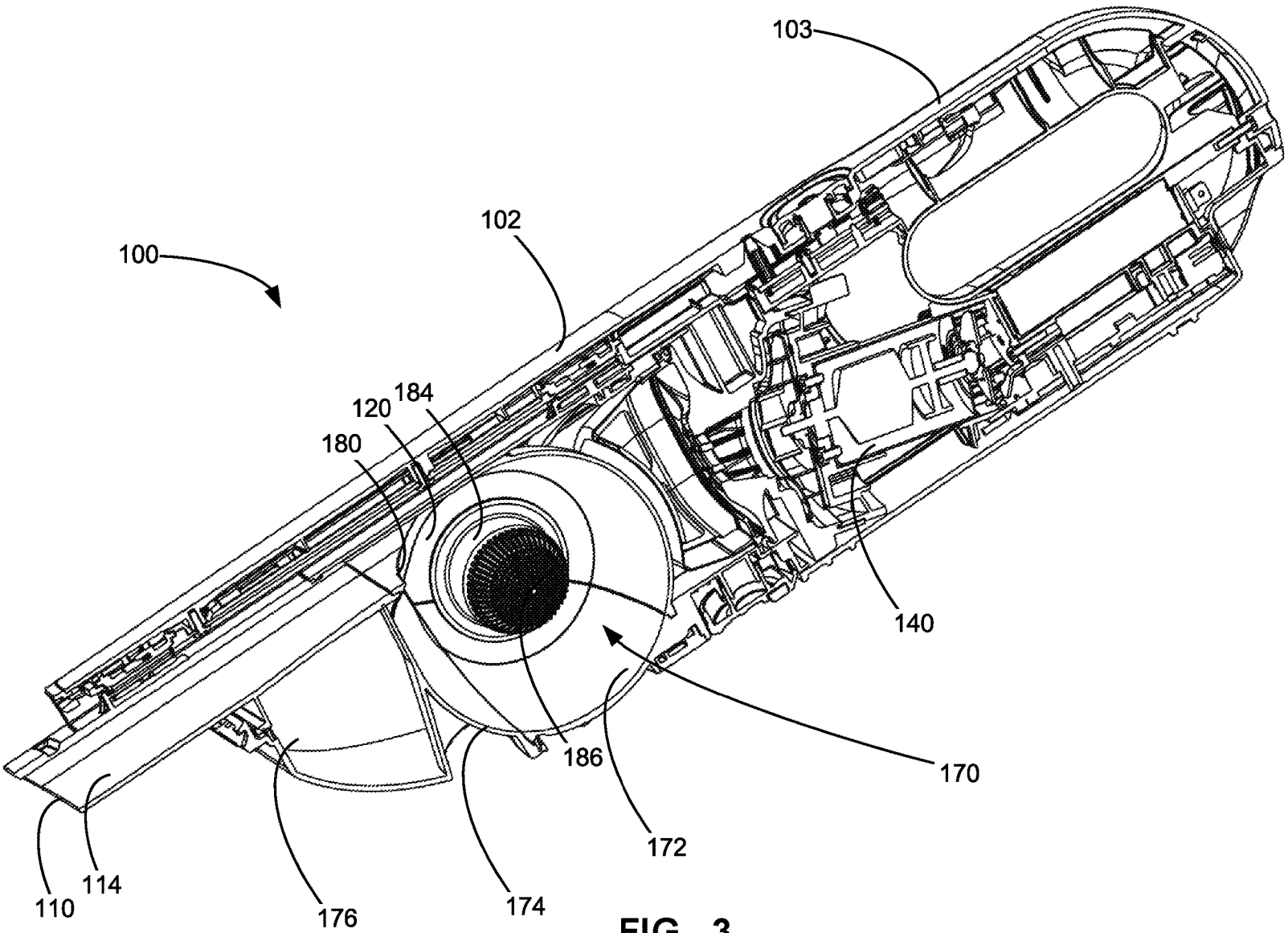
FIG. 3 is a cross-sectional perspective side view of the surface cleaning apparatus of FIG. 1, along the line A-A in FIG. 1.
Figure 4:
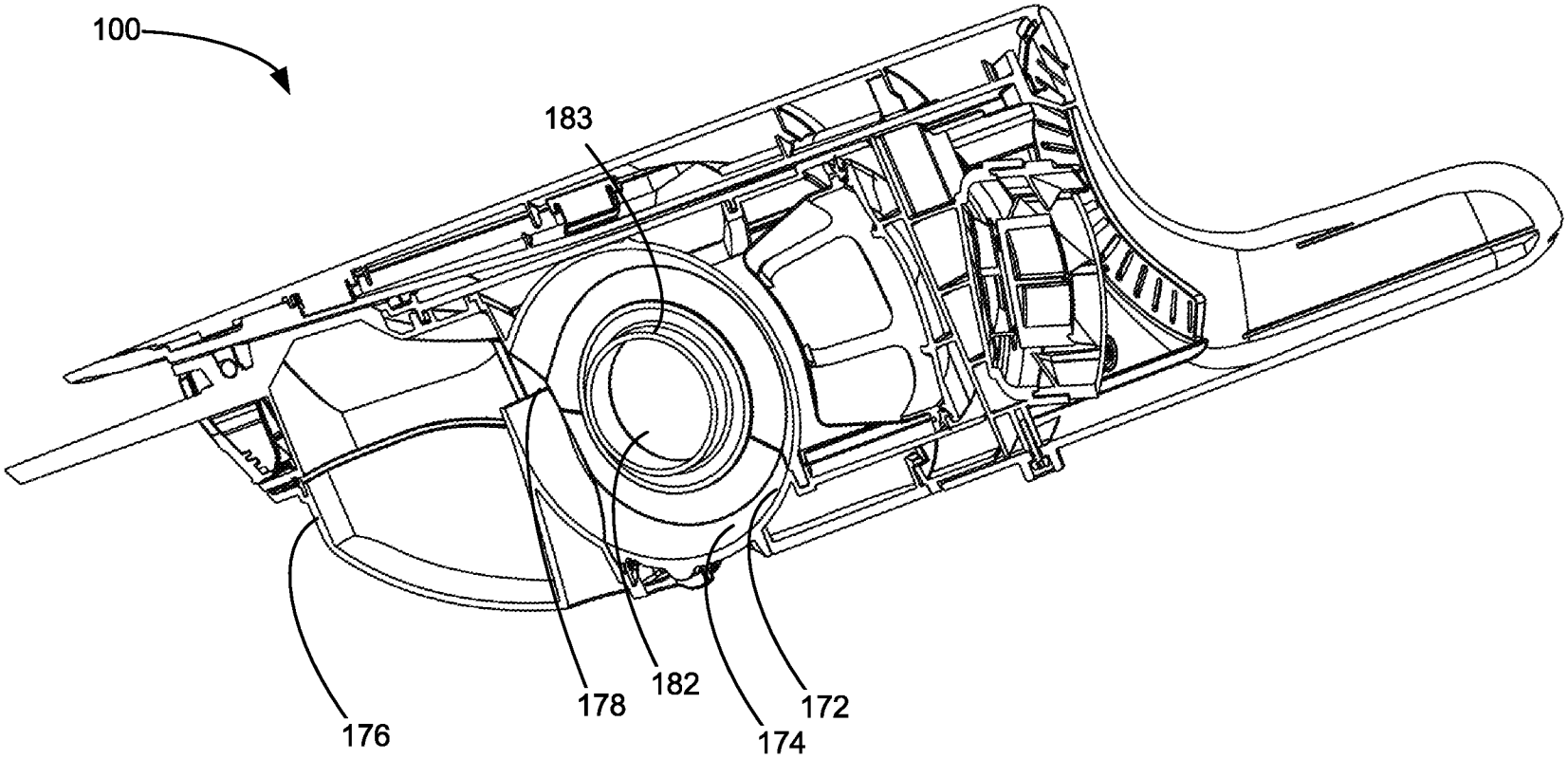
FIG. 4 is a is a cross-sectional perspective side view of an air cleaning member of the surface cleaning apparatus of FIG. 1, along the line A-A in FIG. 1.
Figure 5:
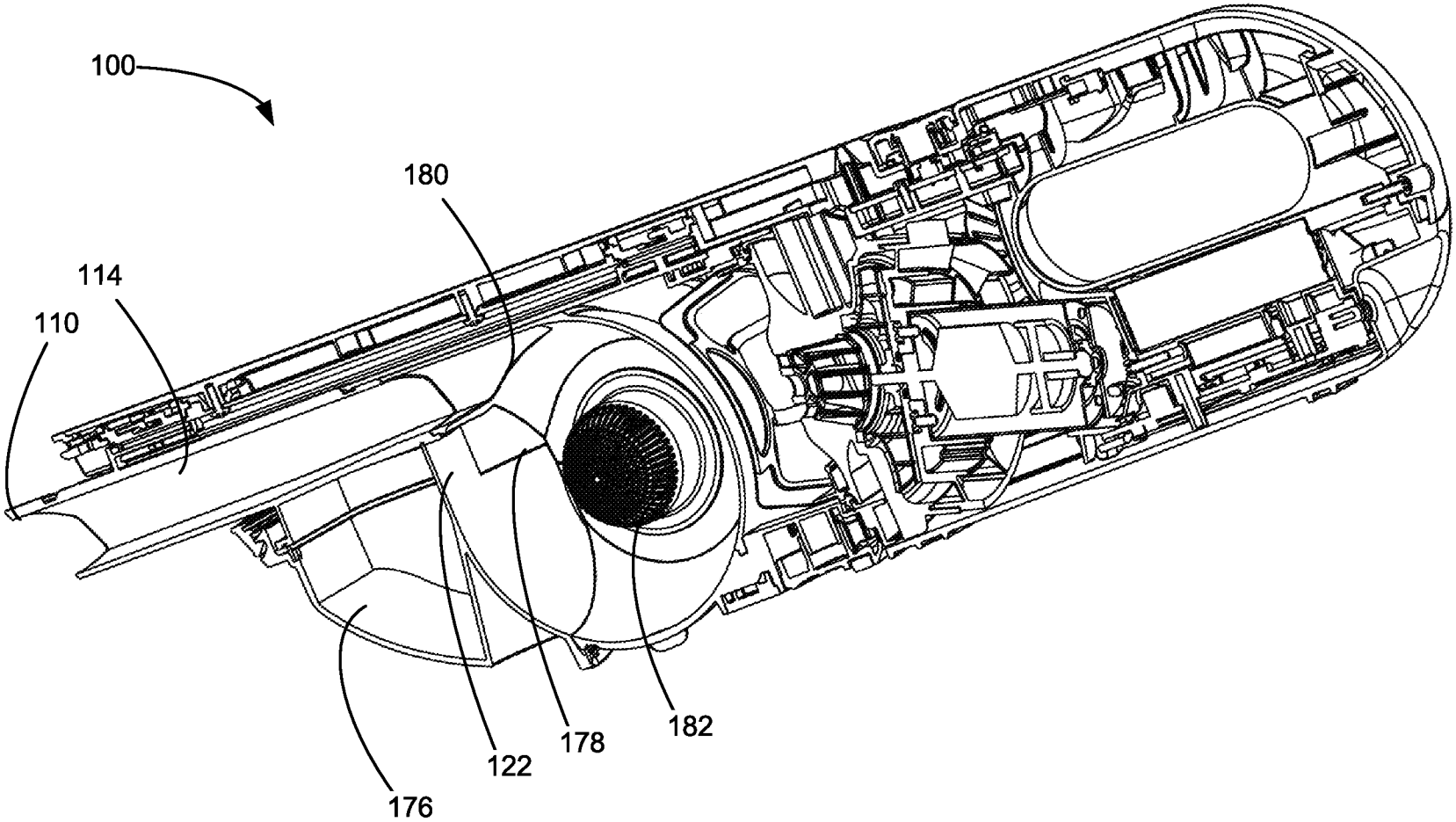
FIG. 5 is a cross-sectional perspective side view of the surface cleaning apparatus of FIG. 1, along the line A-A in FIG. 1.
Figure 6:
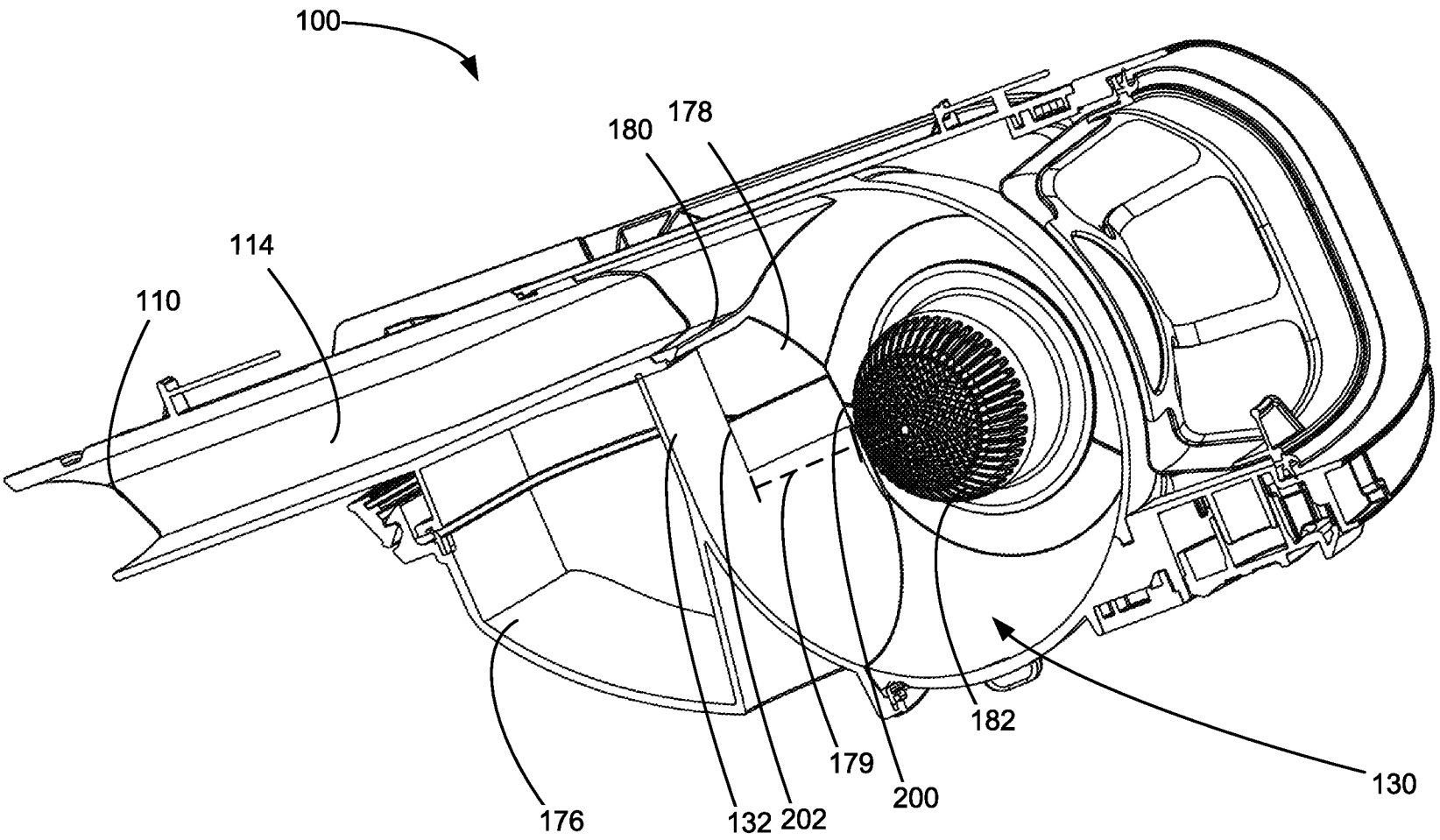
FIG. 6 is a cross-sectional perspective side view of air treatment member of the surface cleaning apparatus of FIG. 1, along the line A-A in FIG. 1.

A suction motor 140 is provided to generate vacuum suction through air flow path 114 (see FIG. 2). Suction motor 140 may be a fan-motor assembly including an electric motor and impeller blade(s). In the illustrated embodiment, suction motor 140 is positioned in the air flow path 114 downstream of air treatment member 120. In this configuration, suction motor 140 may be referred to as a "clean air motor". Alternatively, suction motor 140 may be positioned at alternate locations, such as upstream of air treatment member 120 in which case it may be referred to as a "dirty air motor".

Air treatment member 120 is configured to remove particles of dirt and other debris from the air flow. In the illustrated example, air treatment member 120 includes a cyclone assembly 170 having a single cyclonic cleaning stage with a single cyclone 172 and a dirt collection chamber 176 (see FIG. 3). Cyclone 172 has a cyclone chamber 174. As exemplified in FIGS. 1-13, dirt collection chamber 176 may be external to the cyclone chamber 174 (i.e. dirt collection chamber 176 may have a discrete volume from that of cyclone chamber 174 and in communication with the cyclone chamber by one or more cyclone chamber dirt outlets 178, See FIG. 11). Cyclone 172 and dirt collection chamber 176 may be of any configuration suitable for separating dirt from an air stream and collecting the separated dirt respectively and the cyclone air inlet and cyclone air outlet may be of any design and position known in the art.

In alternate embodiments, air treatment member 120 may include a cyclone assembly having two or more cyclonic cleaning stages arranged in series with each other. Each cyclonic cleaning stage may include one or more cyclones arranged in parallel with each other and one or more dirt collection chambers, of any suitable configuration. The dirt collection chamber(s) may be external to the cyclone chambers of the cyclones. Each cyclone may have its own dirt collection chamber or two or more cyclones fluidically connected in parallel may have a single common dirt collection chamber.

In some embodiments, hand vacuum cleaner 100 may include a pre-motor filter provided in the air flow path 114 downstream of air treatment member 120 and upstream of suction motor 140. The pre-motor filter may be formed from any suitable physical, porous filter media. For example, the pre-motor filter may be one or more of a foam filter, felt filter, HEPA filter, or other physical filter media. In some embodiments, the pre-motor filter may include an electrostatic filter, or the like.

In the illustrated embodiments, dirty air inlet 110 is the inlet end 162 of an air inlet conduit 160 (see FIG. 2). The inlet conduit 160 may also be referred to as the inlet passage 160. Optionally, inlet end 162 of air inlet conduit 160 can be used as a nozzle to directly clean a surface. Alternatively, or in addition to functioning as a nozzle, air inlet conduit 160 may be connected (e.g. directly connected) to the downstream end of any suitable accessory tool such as a rigid air flow conduit (e.g., an above floor cleaning wand), a crevice tool, a mini brush, and the like. As shown, dirty air inlet 110 may be positioned forward of air treatment member 120, although this need not be the case.

In the embodiment of FIGS. 1-13, the air treatment member 120 comprises a generally spherical cyclone 172, the air treatment member air inlet is a single cyclone air inlet 180 (see FIG. 2), and the air treatment member air outlet is two cyclone air outlets 182 (see FIG. 7). As exemplified in FIGS. 2, 3 and 5, the rear or outlet end of air inlet conduit 160 comprises cyclone air inlet 180 and is provided at an upper end of the cyclone 172 and provides a tangential air flow into the cyclone chamber 174. Cyclone air inlet 180 is provided centrally on cyclone 172 and a cyclone air outlet 182 is provided on each lateral side of the cyclone 172.

In operation, after activating suction motor 140, dirty air enters apparatus 100 through dirty air inlet 110 and is directed through air inlet conduit 160 to the cyclone air inlet 180. As exemplified, cyclone air inlet 180 directs the dirty air flow to enter cyclone chamber 174 in a tangential direction so as to promote cyclonic action in cyclone 172. After entering cyclone 172, the air rotates and travels in opposite lateral directions. Accordingly, some air exits the cyclone chamber 174 via the air outlet 182 provided on lateral side 107 and the remainder of the air exits the cyclone chamber 174 via the air outlet 182 provided on the other lateral side 109. Dirt particles and other debris is disentrained (i.e. separated) from the dirty air flow as the dirty air flow rotates in the interior of cyclone 172 while travelling from cyclone air inlet 180 to cyclone air outlets 182. The disentrained dirt particles and debris may be discharged from cyclone chamber 174 through dirt outlets 178 into dirt collection chamber 176 external to the cyclone chamber 174, where the dirt particles and debris may be collected and stored until dirt collection chamber 176 is emptied.

Air exiting cyclone chamber 174 passes through outlet passages 184 located upstream of cyclone air outlets 182 (see FIG. 7). Cyclone chamber outlet passages 184 may also act as vortex finders to promote cyclonic flow within cyclone chamber 174. In some embodiments, cyclone outlet passages 184 may each include an air permeable portion 186 (which may be referred to as a screen or shroud, e.g. a fine mesh screen) in the air flow path 114 to remove large dirt particles and debris, such as hair, remaining in the exiting air flow. As exemplified in FIGS. 3-4, the cyclone air outlets 182 may each comprise a conduit portion 183 which is solid (air impermeable) and an axially inward screen or shroud 186.

From cyclone air outlets 182, the air flow may be directed into the pre-motor filter housing at an upstream side of the pre-motor filter. The air flow may pass through the pre-motor filter, and then exit through pre-motor filter chamber air outlet into suction motor 140 and then discharged from apparatus 100 through clean air outlet 112. Prior to exiting the clean air outlet 112, the treated air may pass through a post-motor filter, which may be one or more layers of filter media.

Power may be supplied to suction motor 140 and other electrical components of apparatus 100 from an onboard energy storage member, which may include, for example, one or more batteries 190 or other energy storage device (see FIG. 2). Batteries 190 may be permanently connected to apparatus 100 and rechargeable in-situ, or removable from apparatus 100. Alternatively, or in addition to batteries 190, power may be supplied to apparatus 100 by an electrical cord (not shown) connected to apparatus 100 that can be electrically connected to mains power by at a standard wall electrical outlet.

Air Treatment Member with Dual Dirt Outlets

In accordance with this aspect, which may be used by itself or in combination with one or more other aspects, the cyclone chamber 174 has dual dirt outlets 178. An advantage of this aspect is that the dirt removal efficiency of the cyclone may be improved. As dirt is disentrained from the air within the air treatment member 120, the likelihood of the dientrained dirt exiting the cyclone chamber without being reintrained is increased by having providing a second dirt outlet 178 and positioning the dirt outlets 178 as set out herein.

In accordance with this aspect, a cyclone chamber has a first end, a second opposed end and a cyclone axis of rotation which intersects each of the first and second axially opposed ends of the cyclone chamber. A cyclone sidewall extends between the first and second axially opposed ends and a cyclone air outlet is provided at each of the first and second opposed ends. An air inlet is axially centrally positioned between the axially opposed ends of the cyclone chamber. A first dirt outlet is provided in the cyclone sidewall on one lateral side of the cyclone chamber (e.g., between the first opposed and the axially positioned midpoint of the cyclone chamber) and second dirt outlet is provided in the cyclone sidewall on the other lateral side of the cyclone chamber (e.g., between the second opposed and the axially positioned midpoint of the cyclone chamber). Accordingly, when the air enters the cyclone chamber, a first part of the air flow may cyclone towards the first opposed side and dirt separated from the first part of the air flow may exit through a first dirt outlet and a second part of the air flow may cyclone towards the second opposed side and dirt separated from the second part of the air flow may exit through a second dirt outlet.

Referring to the embodiment of FIGS. 1-13, the cyclone chamber 174 is generally spherical. It will be appreciated that the cyclone chamber 174 may alternately be generally ellipsoidal or generally cylindrical and, optionally generally spherical or generally ellipsoidal.

Figure 8:
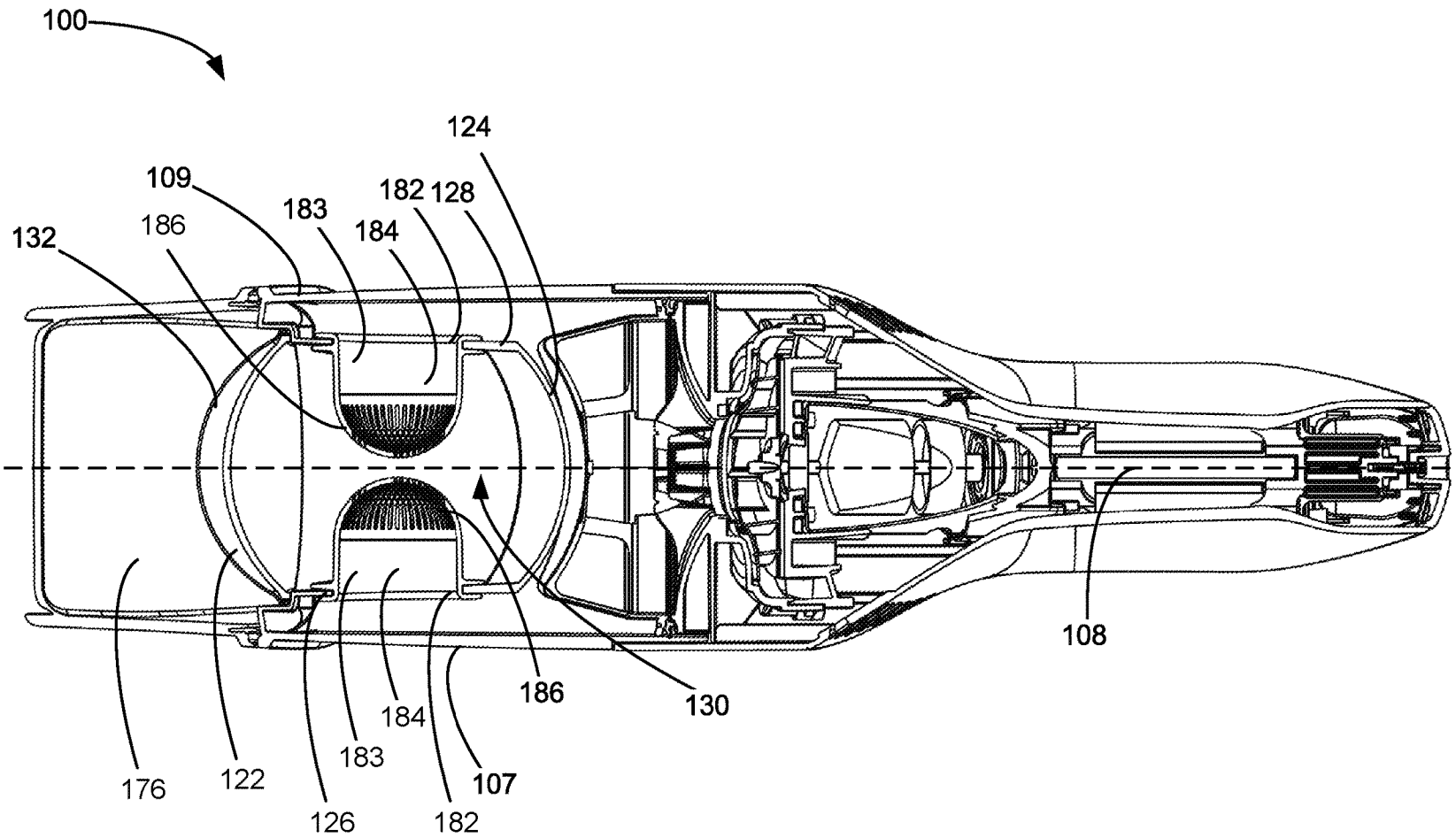
FIG. 8 is a cross-sectional bottom view of the surface cleaning apparatus of FIG. 1, along the line C-C in FIG. 1.

As exemplified in FIG. 8, the air treatment member 120 has first and second opposed portions 122, 124 and third and fourth opposed portions 126, 128. The first, second, third, and fourth portions 122, 124, 126, 128 define a volume 130. As exemplified in FIGS. 3, 7 and 8, the volume 130 is generally spherical. The first portion 122 extends between one side of the third and fourth portions 126, 128, while the second portion 124 extends between another side of the third and fourth portions 126, 128. As exemplified in FIG. 8, the first portion 122 is a front end of the cyclone chamber 174 and the second portion is a rear end of the cyclone chamber 174. Similarly, as exemplified, the third and fourth portions 126, 128 are first and second (right and left) laterally opposed sides of the cyclone chamber 174.

It will be appreciated that the orientation of the cyclone may be varied. For example, the front side, which has the air inlet, may be provided facing an alternate direction. For example, the air inlet may be provided on a lateral side of the apparatus 100, a lower side or the rear side. As exemplified, the cyclone axis of rotation is horizontal and extends laterally side to side when apparatus 100 is oriented horizontally as exemplified in FIG. 2. However, the cyclone axis of rotation may be horizontally disposed but extending in a different direction and/or the cyclone axis of rotation may be not be horizontally disposed when apparatus 100 is oriented horizontally as exemplified in FIG. 2.

Air enters the cyclone chamber 174 through the cyclone air inlet 180. As exemplified in FIGS. 1-13, the cyclone air inlet 180 is positioned centrally between the first and second laterally opposed sides 126, 128. It will be appreciated that the position of the air inlet 180 may be anywhere in the cyclone chamber 174. As exemplified, the air inlet 180 may be located in the front end 122.

Air exits the cyclone chamber 174 through the air outlets 182. The air outlets are at opposed ends of the cyclone chamber wherein the cyclone axis of rotation intersects each air outlet. As exemplified in FIG. 8, the first air outlet 182 is located in the first lateral side 126 and the second air outlet 182 is located in the second lateral side 128. In other words, the first air outlet 182 is located in the third portion 126 and the second air outlet 182 is located in the fourth portion 128. It will be appreciated that if the air inlet is provided at a different location, then the cyclone axis of rotation will have a different orientation and the position of the air outlets 182 will be at an alternate location in apparatus 100.

Once dirt has been disentrained from the air, dirt may exit the cyclone chamber 174 through the dirt outlets 178. As exemplified in FIG. 9, the first dirt outlet 178 is provided between the body axis 108 and the first laterally opposed side 126, while the second dirt outlet 178 is provided between the body axis 108 and the second laterally opposed side 128.

Figure 9:
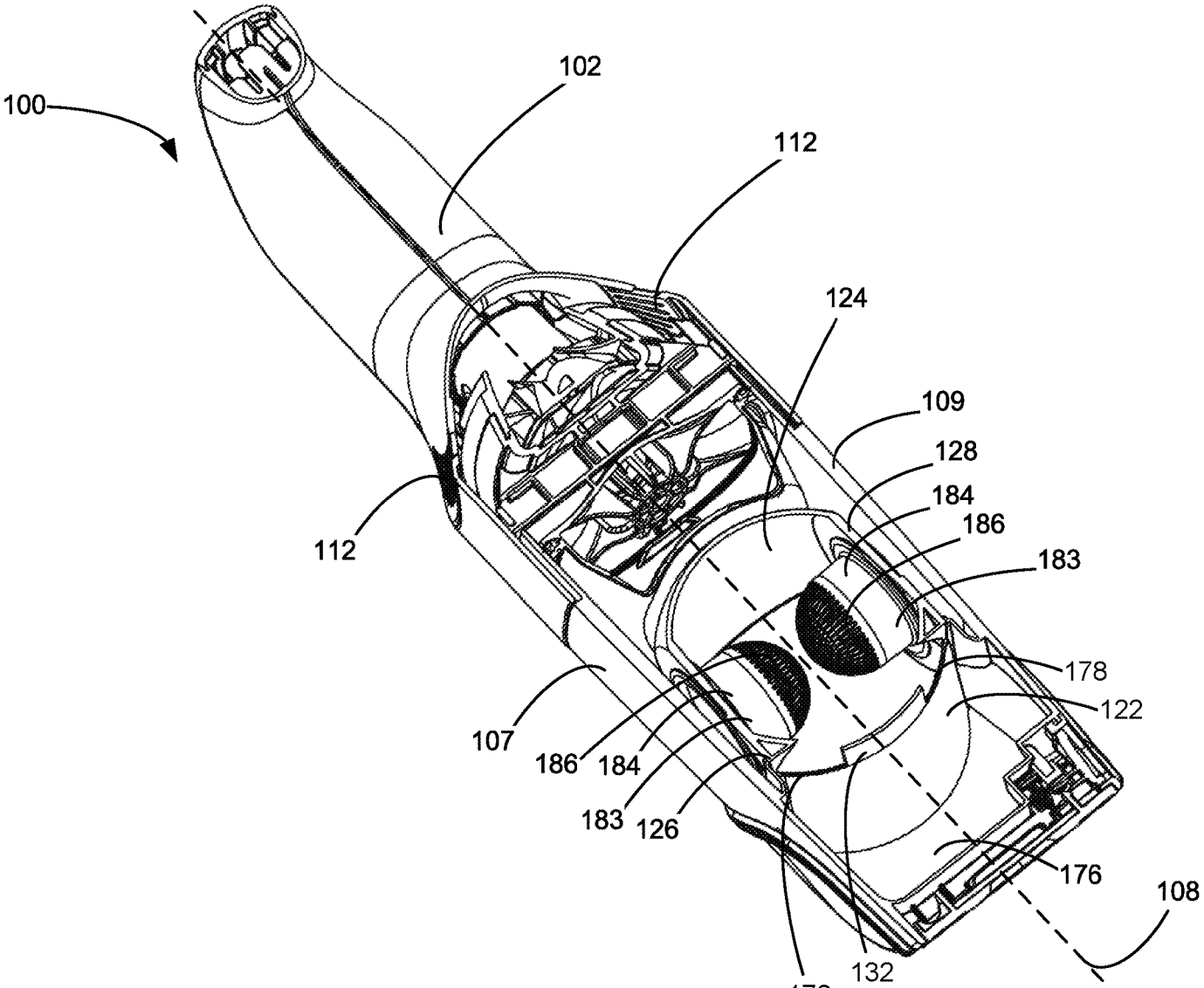
FIG. 9 is a cross-sectional perspective bottom view of the surface cleaning apparatus of FIG. 1, along the line D-D in FIG. 1.
Figure 10:
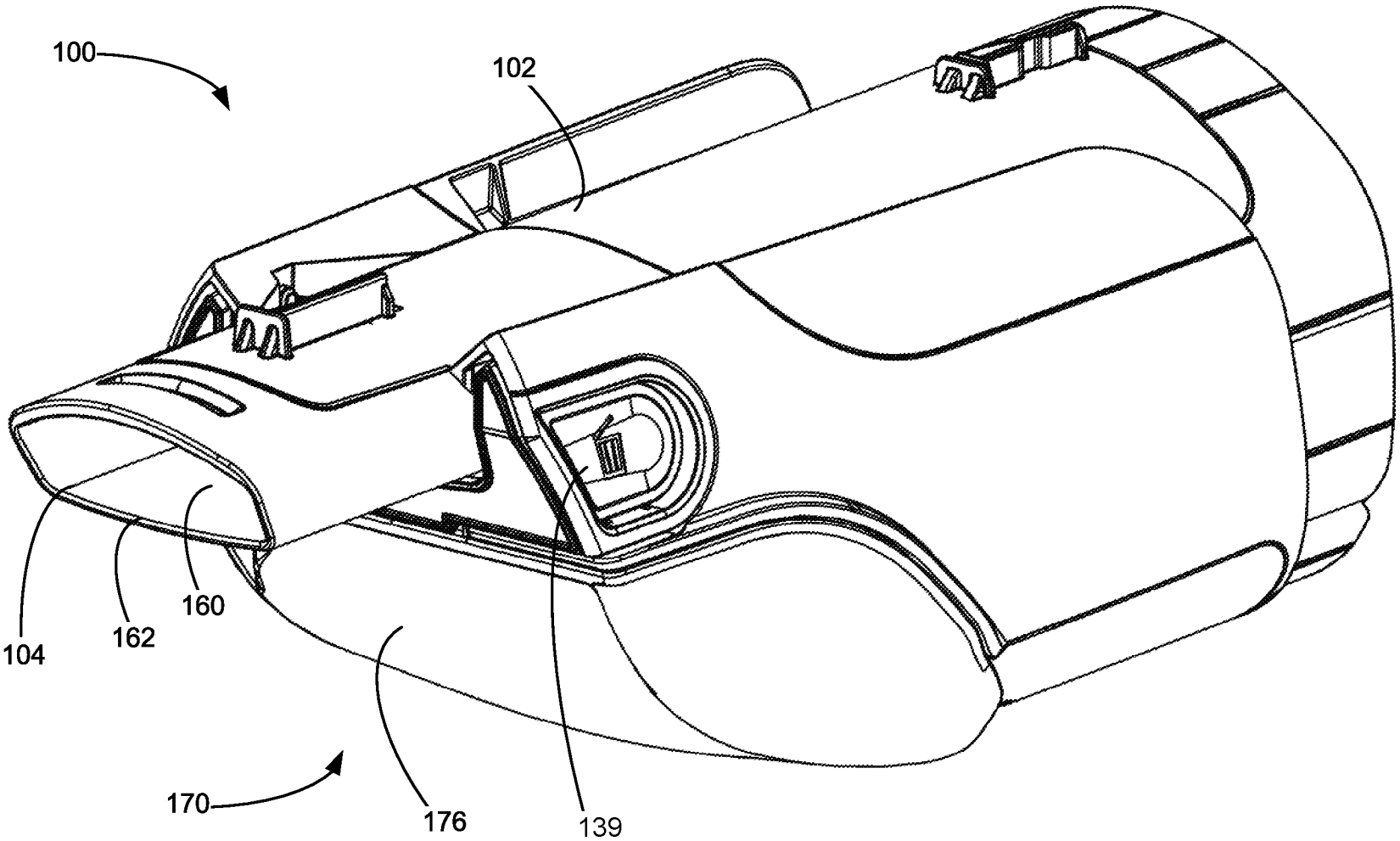
FIG. 10 is a front perspective view of the air treatment member of the surface cleaning apparatus of FIG. 1.
Figure 11:
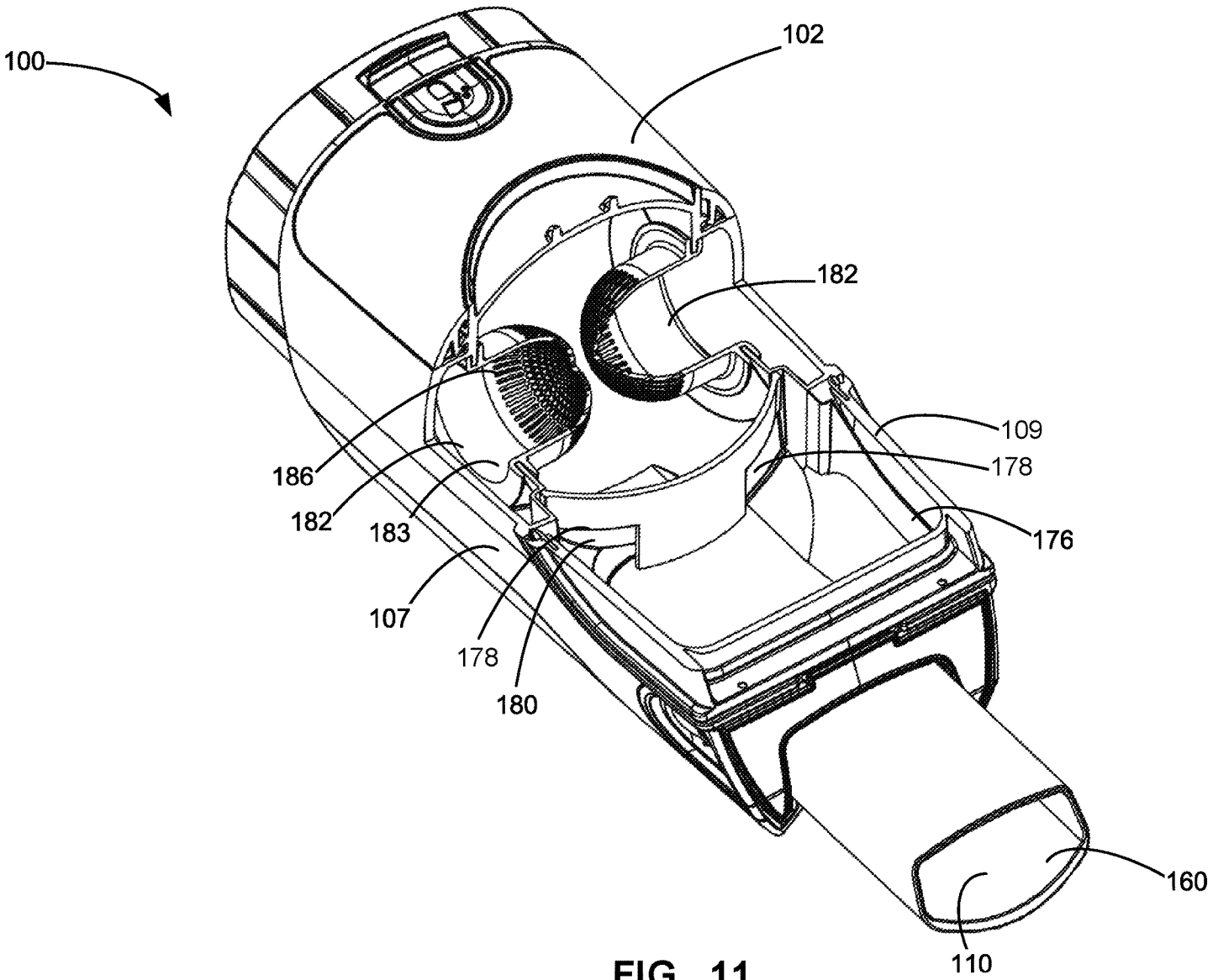
FIG. 11 is a sectional bottom perspective view of the air treatment member of the surface cleaning apparatus of FIG. 1, along the lines B-B and C-C of FIG. 1.

As exemplified in FIG. 9, each dirt outlet 178 is a single contiguous opening in the sidewall of the cyclone chamber 174. However, it will be appreciated that one or both dirt outlets 178 may comprise a plurality of openings in the sidewall and, accordingly, each dirt outlet may comprise three, four, five, six, etc. openings in the cyclone sidewall.

It will be appreciated that the lateral position of the dirt outlets 178 may vary. For example, as exemplified, at least a portion of the first dirt outlet 178 is laterally positioned between the air inlet 180 and the third portion 126 and at least a portion of the second dirt outlet 178 is laterally positioned between the air inlet 180 and the fourth portion 128. Positioning the dirt outlets 178 between the air inlet 180 and the third and fourth portions 126, 128, respectively, may improve the efficiency of the surface cleaning apparatus 100. For example, positioning the dirt outlets 178 laterally from the air inlet 180 may allow for air entering the air treatment member 120 to complete, e.g., a half or a full rotation of the air treatment chamber 120 before reaching one of the dirt outlets 178.

It will also be appreciated that the lateral positioning of the dirt outlets 178 relative to the air inlet 180 may vary. Each dirt outlet 178 has a width 179 in a plane transverse to the body axis 108. As exemplified in FIGS. 1-13, the first dirt outlet 178 is positioned such that all of the width 179 is positioned between the air inlet 180 and the first lateral side 126 (i.e., all of the dirt outlet 178 is positioned between the air inlet 180 and the first lateral side 126). Similarly, the second dirt outlet 178 is positioned such that all of the width 179 is positioned between the air inlet 180 and the second lateral side 128. It will be appreciated that, in some embodiments, only a portion of the width 179 of the first and/or second dirt outlets 178 may be between the air inlet 180 and the lateral side 126, 128. For example, at least 50%, 60%, and 75% or more of the of the width 179 of the first and/or second dirt outlets 178 may be between the air inlet 180 and the lateral side 126, 128.

It will be appreciated that the shape of the dirt outlets 178 may vary. As exemplified in FIGS. 1-13, the dirt outlets 178 are formed by generally rectangular slots in the front end 122. In some embodiments, the dirt outlets 178 may be circular, oblong, square, triangular, etc.

It will also be appreciated that the size of the dirt outlets 178 may vary. As exemplified in FIGS. 1-13, the width 179 of the dirt outlets 178 is approximately one third the width of the front end 122. However, the width 179 may be approximately one quarter or one fifth the width of the front end 122.

As described previously, a single dirt collection chamber 176 is in communication with both of the dirt outlets 178. In alternate embodiments, the surface cleaning apparatus 100 may have more than one dirt collection chamber 176. For example, there may be two dirt collection chambers. The first dirt collection chamber may collect dirt from the first dirt outlet 178, while the second dirt collection chamber may collect dirt from the second dirt outlet 178.

It will be appreciated that the position of the dirt collection chamber 176 may vary. For example, as exemplified in FIGS. 1-13, a portion of the dirt collection chamber 176 is positioned forward the air treatment member 120. In some embodiments, the entire dirt collection chamber 176 may be positioned forward of the air treatment member 120.

Moveable Wall Portion

In accordance with this aspect, which may be used by itself or in combination with one or more other aspects, the air treatment member 120 has a moveable wall portion 132 with the first and second dirt outlets 178 provided in the wall portion 132. The wall portion 132 is moveable between a closed position and an open position, whereby the air treatment member 120 is emptyable. An advantage of this design is that, when the dirt collection chamber 176 is emptied, any remaining dirt in the air treatment member 120 may also be removed simultaneously. Additionally, when the wall portion 132 is opened, a user may access the air treatment member 120 to remove larger debris that has not exited through the dirt outlets 178. For example, hair that is wrapped around shroud 186 and large dirt such as popcorn may be removed by the user through the opened wall portion 132.

As shown, the first and second dirt outlets 178 are separated by a wall portion 132 that extends laterally between the dirt outlets 178. In other words, the first and second dirt outlets 178 each have an outer side 200 positioned adjacent the first and second laterally opposed sides 126, 128 respectively, and an opposed inner side 202. The wall portion 132 is positioned between the inner sides 202 of each dirt outlet 178.

As exemplified, the surface cleaning apparatus 100 includes the inlet passage 160 extending from the dirty air inlet 110 to the air treatment member 120. When the inlet passage 160 is oriented horizontally and the dirty air inlet 110 is located at an upper end of the surface cleaning apparatus 100, the air inlet 180 is located in an upper end of the air treatment member 120 and the wall portion 132 extends downwardly from the inlet 180. As exemplified, the first and second dirt outlets 178 are located below the air inlet 180.

To empty the dirt collection chamber 176, the air treatment member 120 includes a movable portion. As exemplified in FIG. 13, the lower front portion of the dirt collection chamber is moveable (e.g., pivotally moveable) to an opened position.

As exemplified in FIGS. 1-13, the first portion 122, or front end 122, includes the wall portion 132. The first portion 122 is moveable between an open position, as exemplified in FIGS. 12 and 13, in which the cyclone chamber 174 is opened and the air treatment member 120 is emptyable, and a closed position, as exemplified in FIG. 10. As exemplified, the first portion 122 is moveable concurrently with the openable portion of the dirt collation chamber 176. Accordingly the cyclone and dirt collection chambers may be concurrently emptied.

Figure 12:
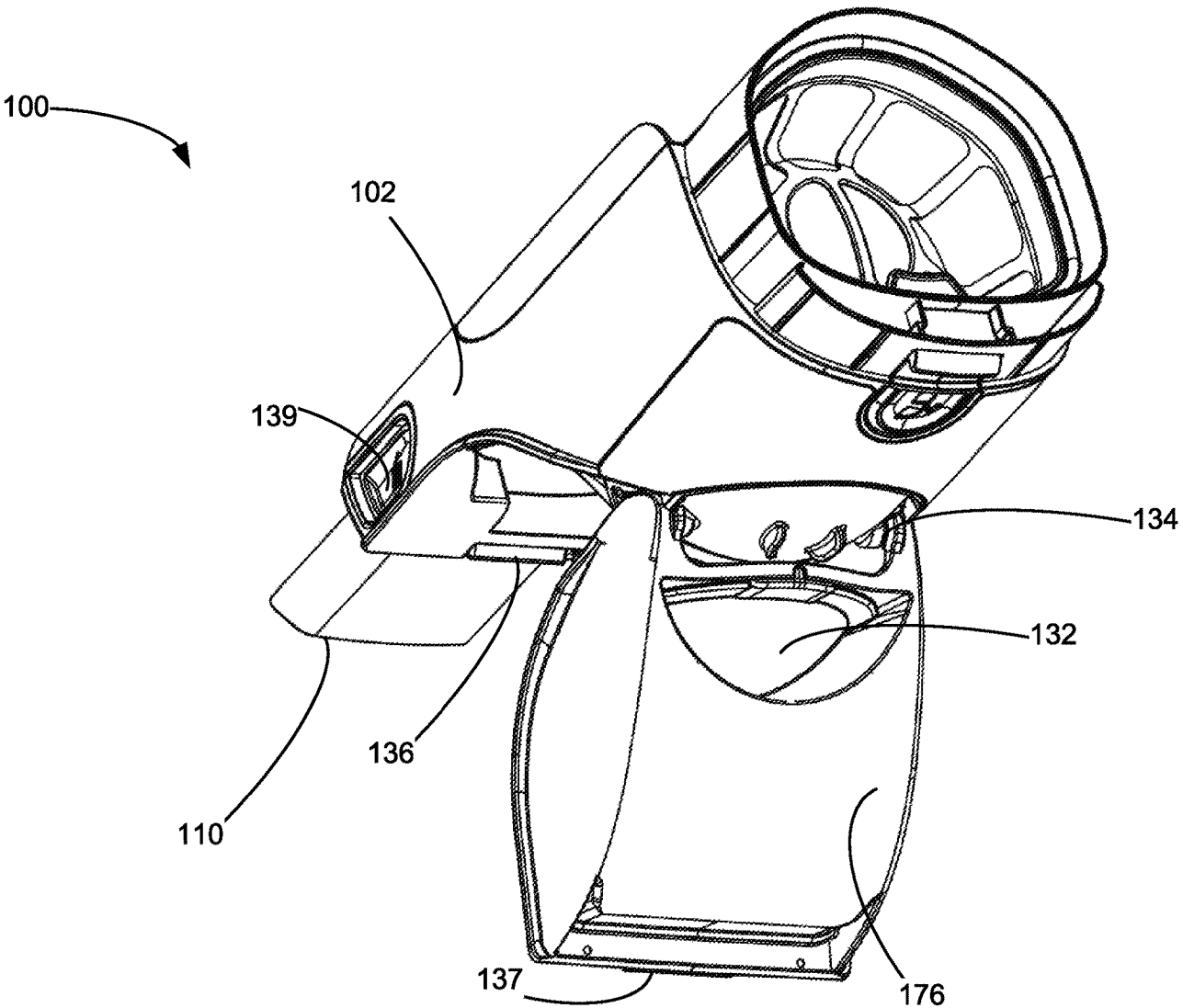
FIG. 12 is a rear bottom perspective view of the air treatment member of the surface cleaning apparatus of FIG. 1; and, FIG. 13 is a front bottom perspective view of the air treatment member of the surface cleaning apparatus of FIG. 1.
Figure 13:
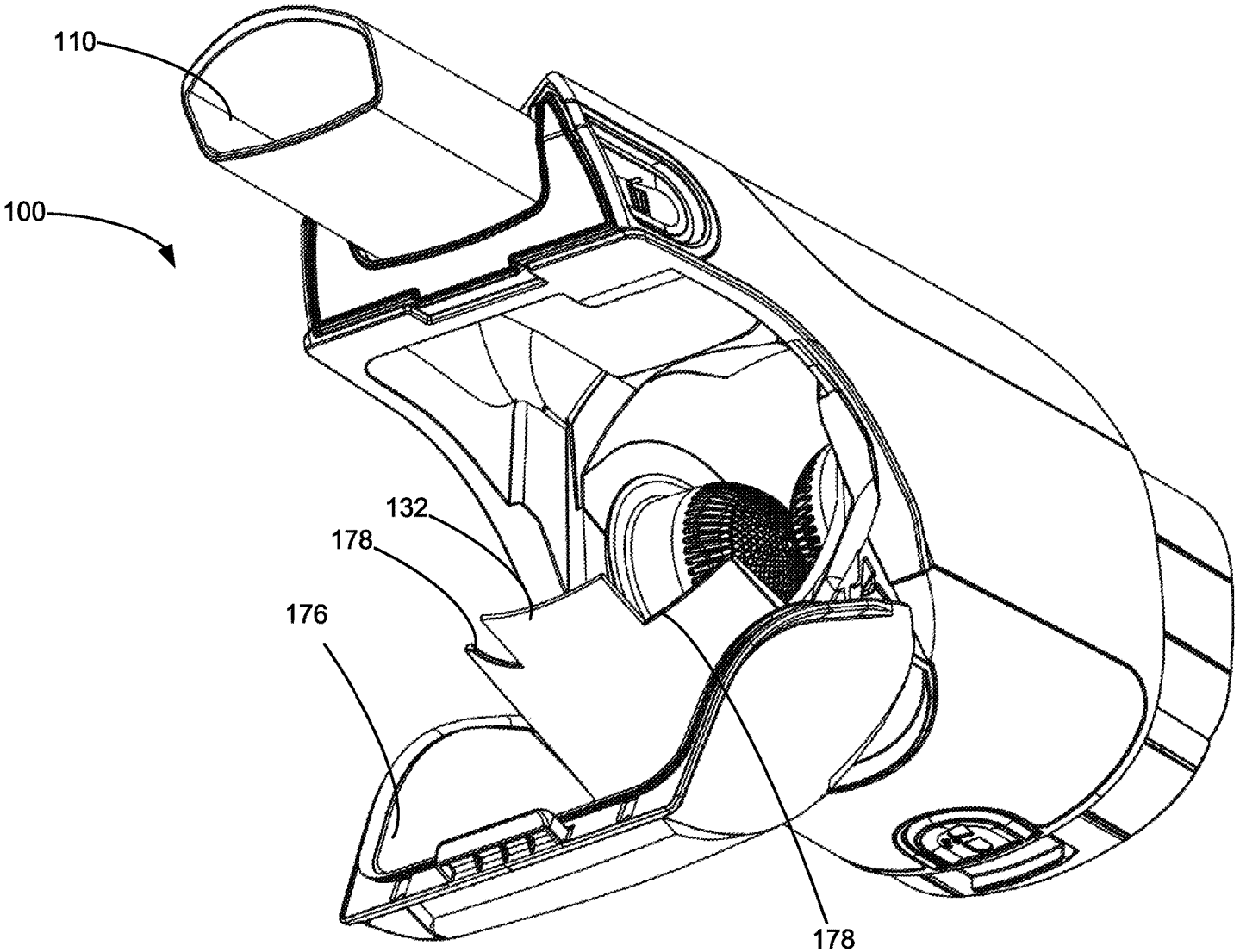

As exemplified in FIG. 12, the movable wall portion 132 moves with the dirt collection chamber 176 about a pivot 134. To secure the dirt collection chamber 176 to the surface cleaning apparatus 100, a clasp 136 having a first portion 137 on the main body 102 and a second portion 138 on the dirt collection chamber 176 is used. The first and second portions 137 and 138 are engageable. During use, as exemplified, a release 139 may be pressed to disengage the first portion 127 from the second portion 138, thereby allowing the dirt collection chamber 176 to rotate about pivot 134. After emptying, the dirt collection chamber 176 may be rotated upwards to reengage the clasp 136.

While the above description describes features of example embodiments, it will be appreciated that some features and/or functions of the described embodiments are susceptible to modification without departing from the spirit and principles of operation of the described embodiments. For example, the various characteristics which are described by means of the represented embodiments or examples may be selectively combined with each other. Accordingly, what has been described above is intended to be illustrative of the claimed concept and non-limiting. It will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. A hand held surface cleaning apparatus comprising:

(a) a body having a front end, a rear end, a body axis extending between the front and rear ends and first and second laterally opposed sides positioned on opposed sides of the body axis;

(b) an air flow path extending from a dirty air inlet to a clean air outlet, the dirty air inlet is located at the front end;

(c) an air treatment member provided in the air flow path, the air treatment member having a front end, a rear end, first and second laterally opposed sides, an air treatment member air inlet centrally positioned between the first and second laterally opposed sides of the air treatment member, a first air outlet provided in the first laterally opposed side of the air treatment member, a second air outlet provided in the second laterally opposed side of the air treatment member, a first dirt outlet provided between the body axis and the first laterally opposed side of the air treatment member and a second dirt outlet provided between the body axis and the second laterally opposed side of the air treatment member wherein a dividing structure separates the first and second dirt outlets whereby the first and second dirt outlets are discrete from each other;

(d) at least one dirt collection chamber in communication with the dirt outlets; and, (e) a suction motor provided in the air flow path.

2. The hand held surface cleaning apparatus of claim 1 wherein the at least one dirt collection chamber comprises a dirt collection chamber wherein at least a portion of the dirt collection chamber is positioned forward of the air treatment member.

3. The hand held surface cleaning apparatus of claim 2 wherein a forward side of the air treatment member has a wall portion that extends laterally between the first and second dirt outlets.

4. The hand held surface cleaning apparatus of claim 3 further comprising an inlet passage extending from the dirty air inlet to the air treatment member and, when the inlet passage is oriented generally horizontally and the dirty air inlet is located at an upper end of the hand held surface cleaning apparatus, the air treatment member air inlet is located in an upper end of the air treatment member and the wall portion extends downwardly from the air treatment member air inlet.

5. The hand held surface cleaning apparatus of claim 4 wherein the wall portion is moveably mounted between a closed position and an open position in which the air treatment member is opened whereby the air treatment member is emptyable.

6. The hand held surface cleaning apparatus of claim 1 wherein the at least one dirt collection chamber is a single dirt collection chamber.

7. The hand held surface cleaning apparatus of claim 1 wherein the air treatment member comprises a cyclone.

8. The hand held surface cleaning apparatus of claim 1 wherein the air treatment member is generally spherical.

9. The hand held surface cleaning apparatus of claim 1 wherein the first dirt outlet has a width in a plane transverse to the body axis and at least 50% of the width is positioned between the air inlet and the first lateral side.

10. The hand held surface cleaning apparatus of claim 1 wherein the first dirt outlet has a width in a plane transverse to the body axis and at least 75% of the width is positioned between the air inlet and the first lateral side.

11. The hand held surface cleaning apparatus of claim 1 wherein, in use, the dirty air inlet is located at an upper end of the hand held surface cleaning apparatus and the air treatment member air inlet is located in an upper end of the air treatment member and the first and second dirt outlets are located below the air treatment member air inlet.

12. A surface cleaning apparatus comprising:

(a) an air flow path extending from a dirty air inlet to a clean air outlet;

(b) a generally spherical air treatment member provided in the air flow path, the air treatment member having a volume defined by first and second opposed portions and third and fourth opposed portions, the first portion extends between one side of the third and fourth portions and the opposed second portion extends between another side of the third and fourth opposed portions, the air treatment member has an air treatment member air inlet positioned in the first portion, a first air outlet provided in the third portion, a second air outlet provided in the fourth portion, a first dirt outlet provided in the first portion wherein at least a portion of the first dirt outlet is positioned between the air treatment member air inlet and the third portion and a second dirt outlet wherein at least a portion of the second dirt outlet is positioned between the air treatment member air inlet and the fourth portion wherein a dividing structure separates the first and second dirt outlets whereby the first and second dirt outlets are discrete from each other;

(c) at least one dirt collection chamber in communication with the dirt outlets; and, (d) a suction motor provided in the air flow path.

13. The surface cleaning apparatus of claim 12 wherein the at least one dirt collection chamber is a single dirt collection chamber.

14. The surface cleaning apparatus of claim 12 wherein the air treatment member comprises a cyclone.

15. The surface cleaning apparatus of claim 12 wherein at least 50% of the first dirt outlet is positioned between the air treatment member air inlet and the third portion.

16. The surface cleaning apparatus of claim 12 wherein at least 75% of the first dirt outlet is positioned between the air treatment member air inlet and the third portion.

17. The surface cleaning apparatus of claim 12 wherein the first portion is moveably mounted between a closed position and an open position in which the air treatment member is opened whereby the air treatment member is emptyable.

18. A surface cleaning apparatus comprising:

(a) an air flow path extending from a dirty air inlet to a clean air outlet;

(b) an air treatment member provided in the air flow path, the air treatment member comprising an air treatment member air inlet, a first air outlet, a second opposed air outlet, a first dirt outlet and a second dirt outlet wherein each of the first and second dirt outlets have a perimeter and at least two sides of the perimeter of each dirt outlet are provided by a wall portion and the wall portion is moveably mounted between a closed position and an open position in which the air treatment member is opened whereby the air treatment member is emptyable wherein a section of the wall portion separates the first and second dirt outlets from each other whereby the first and second dirt outlets are discrete from each other;

(c) at least one dirt collection chamber in communication with the dirt outlets; and, (d) a suction motor provided in the air flow path.

19. The surface cleaning apparatus of claim 18 wherein the at least one dirt collection chamber is a single dirt collection chamber.

20. The surface cleaning apparatus of claim 18 further comprising a front end, a rear end, an axis extending between the front and rear ends and first and second laterally opposed sides positioned on opposed sides of the axis, wherein the first dirt outlet has an outer side positioned adjacent the first lateral side and an opposed inner side, the second dirt outlet has an outer side positioned adjacent the second lateral side and an opposed inner side and the section of the wall portion positioned between the inner side of the first dirt outlet and the inner side of the second dirt outlet.

* * * * *